United States Patent [19]

Merony et al.

[11] 4,189,356

[45] Feb. 19, 1980

[54] METHOD FOR PLATING COPPER ON STEEL RODS

[75] Inventors: Donald E. Merony, Portland, Tenn.; William W. Hicks, Barington; Gregory T. Parkos, Providence, both of R.I.

[73] Assignee: Whittaker Corporation, Los Angeles, Calif.

[21] Appl. No.: 881,582

[22] Filed: Feb. 27, 1978

Related U.S. Application Data

[62] Division of Ser. No. 751,258, Dec. 17, 1976, abandoned.

[51] Int. Cl.[2] ..... C25D 5/10; C25D 7/00; C25D 3/38; C25D 17/08

[52] U.S. Cl. ..... 204/25; 204/40; 204/52 R; 204/297 W

[58] Field of Search ..... 204/25, 40, 239, 277, 204/52 R

[56] References Cited

U.S. PATENT DOCUMENTS

| | | | |
|---|---|---|---|
| 686,395 | 11/1901 | Dessolle | 204/239 |
| 1,249,787 | 12/1917 | Leuchter | 204/277 |
| 1,423,815 | 7/1922 | Park | 204/277 |
| 2,424,887 | 7/1947 | Henricks | 204/52 R |
| 3,546,080 | 12/1970 | Iannone | 204/25 |
| 3,689,380 | 9/1972 | Clauss | 204/40 |

*Primary Examiner*—T. M. Tufariello
*Attorney, Agent, or Firm*—Kenway & Jenney

[57] ABSTRACT

A method and apparatus for high speed electroplating of steel rods in a bright acid copper bath. The rods bearing a nickel strike coating are supported on racks in vertical tiers, the racks making electrical connections exclusively from the ends of each rod to a cathode bar. The acid copper bath solution is subjected to constant air agitation and constantly recirculated to a heat exchanger for maintenance of a preselected temperature.

6 Claims, 9 Drawing Figures

HEAT EXCHANGER
24
AIR
P
F
(+)
(-)

FIG. 4
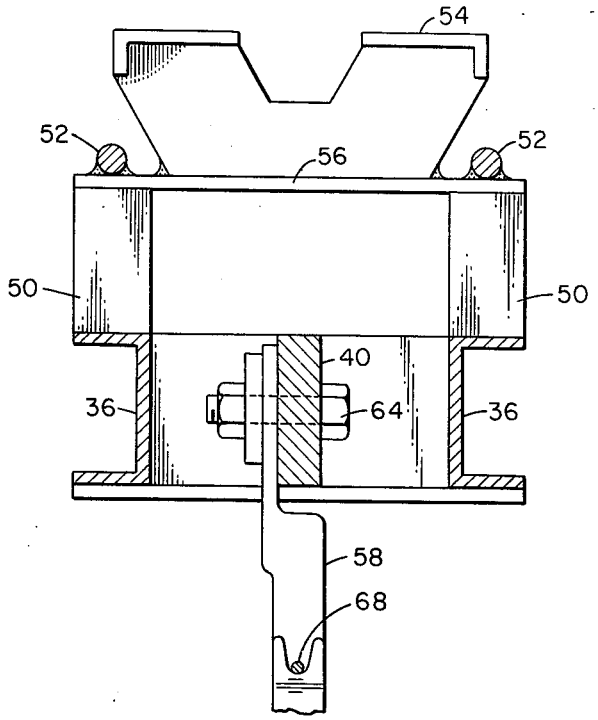
FIG. 5
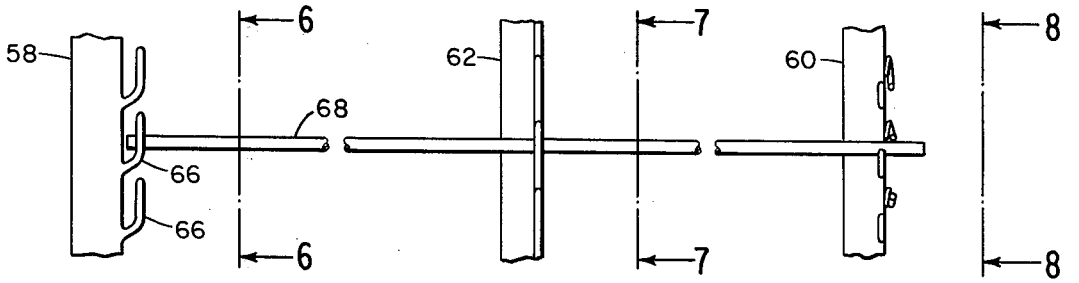
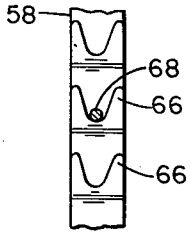
FIG. 6
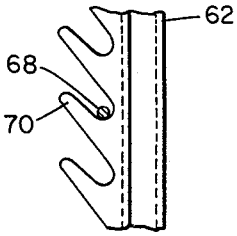
FIG. 7
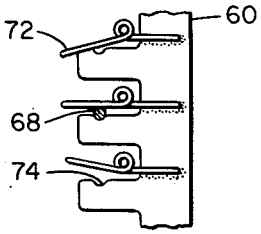
FIG. 8

METHOD FOR PLATING COPPER ON STEEL RODS

This is a division of application Ser. No. 751,258, filed Dec. 17, 1976, now abandoned.

BRIEF SUMMARY OF THE INVENTION

This invention relates generally to the manufacture of ground rods and like products. More particularly, the invention relates to a method and apparatus for rapidly plating steel core rods with a sufficient thickness of dense, non-porous copper to protect the steel core from corrosion and to provide a durable electrical connection between the ground and a clamp for connection to a structure or equipment to be grounded.

It is long been known that a copper thickness of 0.007 inch bonded over a steel core provides a ground rod having a useful life of at least 30 years in almost all soils normally encountered. The principal publication on this subject is the National Bureau of Standards Circular No. 579 entitled "Underground Corrosion." In view of the saving in copper as compared with solid copper rods, certain manufacturing processes for producing copper bonded steel rods have been in commercial use for many years. An early method was to cast copper around a steel billet or wire which was then rolled to the desired finished diameter to produce a copper clad rod. In the practice of this method, great care must be taken to prevent voids from being created between the copper and the steel due to the lack of concentricity resulting from the forming operation and the consequent lack of adherence. The presence of such voids could ultimately result in accelerated corrosion of the steel core and reduction in the useful life of the ground rod.

According to another known method, copper is electroplated upon coils of steel wire. The coils of wire are continuously axially rotated to dip the turns repetitively into and out of a cyanide copper solution. Thus the thickness of the copper plating builds up as the result of repeated immersions in the plating solution or bath. In the practice of this method, care must be taken to avoid the introduction of undesirable products of oxidation and contaminants such as plant dust that may be layered into the plate each time a coil leaves the solution. In use, such contaminants reduce adhesion between laminae and provide localities for accelerated corrosion, producing voids through which ground moisture may attack the steel core. A further drawback of this method is that the cyanide in the bath is an undesirable pollutant and difficult to dispose of without damaging the environment.

The plating industry has long known that in place of a cyanide bath, an acid copper bath may be employed. In this bath a sufficient concentration of sulfuric acid is provided to maintain bath conductivity. Copper sulfate is present to supply the necessary copper ions in solution. Chloride ions must also be present, either by addition of hydrochloric acid or as the result of the chlorination of the municipal water supply. Typically, other agents are added to the bath to enhance the luster and leveling of the deposited copper. These brighteners are commercially available as proprietary compounds.

The use of bright acid copper plating has hitherto applied to a wide variety of work pieces as to shape, material content and surface characteristics. Published material on the process states that various parameters must be held within maximum and minimum limits. For example, the prescribed temperature range for the plating bath has been described as between 70° and 80° F., above which the literature states that the finish dulls due to the breakdown of the brighteners which also contaminates the bath.

Still further and economically important limitations in bright acid copper plating have been described in the literature with respect to the permissible cathode current densities as measured at the surface to be plated. Published standards call for an upper limit of between 50 and 75 amperes per square foot, with greater current densities being described as producing a rough or powdery deposit of the copper, referred to as "burning."

For the reasons above noted, the current densities commonly employed in bright acid copper plating processes have been such as to require considerable time periods for plating even modest thicknesses of copper upon the work pieces. For example, plating 0.010 inch of copper on steel rods would require 177 minutes at 60 amperes per square foot, according to published tables used in the industry. The duration of time required for copper plating to achieve the requisite quality and thickness of plating has very large economic implications. The industry standards that have developed for copper bonded rods, which result from the particular and unique conditions under which they are used, are such that the employment of established bright acid copper plating processes within the generally accepted limits of operation would require an extremely long period of immersion in the plating bath and the resulting costs of manufacture would render the process uneconomical.

An important object of this invention is to provide an improved method and apparatus for bright acid copper plating that is economical. This would permit the attainment of the inherent advantages that this plating method has over cyanide plating. Such advantages includes a copper plate with a finer grain structure and a smoother, harder and more uniform surface, better leveling or ability to fill in imperfections in the surface of the steel core, substantially greater ductility of the copper plating and the elimination of cyanide, —a hazardous substance.

As noted above, the object of attaining an economical process for the production of ground rods must be viewed in the light of the established structural and performance standards for such rods. The pertinent references are currently Underwriters' Laboratories Specification 467 and American National Standards Institute Specification 33.8 (1972). These specifications call for a steel core rod not less than one-half inch in diameter and up to one inch diameter with a copper jacket having a minimum thickness of 0.010 inch at any point. Adherence of the copper jacket must be demonstrated by driving the plated rod between two steel clamping plates or jaws of a vice set to shear off sufficient metal to expose the bond between the jacket and rod which shall exhibit no evidence of bond separation. Further, there shall be no evidence of cracking of the jacket if at room temperature a length of the rod is rigidly held in a clamp or vice and the free end bend by applying a force normal to the rod at a distance from the clamping device equal to 40 times the rod diameter. The magnitude of the force and the direction of application shall be such that the rod is permanently bent to a 30 degree angle.

The achievement of an economical plating process requires not only the satisfaction of the foregoing specifications, but also the achievement of economies in the use of materials and the disposal of waste products. An additional important object of this invention is to minimize the build-up of copper sulfate which was predicted to result from current densities and plating solution temperatures above the recommended limits. In this respect, it has long been known that a degree of control over the build-up of copper sulfate can be attained by using copper anodes containing small amounts of phosphorous. To be effective, this phosphorous must be more than sufficient to combine with the oxygen in the copper anodes to form phosphate. However, such control has been generally applied only to the established cathod current density levels noted above.

A further object of this invention is to achieve the desired economical operation without an unduly high rate of consumption of brightener additives.

Having in view the foregoing and other objects hereinafter appearing, this invention employs bright acid copper plating at bath temperatures above 110° F. and at cathode current densities substantially higher than the previously published maximums, for example 120 amperes per square foot and up to 240 amperes per square foot, with consequent large reductions in immersion times for adequate plating up to the foregoing standards. By the careful control of all process conditions, the build-up of copper sulfate at these higher cathode current densities has been reduced below the levels predicted from published information. Further, the rate of consumption of brightener additives has been reduced to 66% of predicted levels.

The plating apparatus herein described comprises racks for supporting the steel core rods horizontally in vertically arranged tiers. The rods remain continuously immersed in the copper plating bath until the desired thickness of plating has been deposited.

While the foregoing results are attributable to a substantial number of factors entering into the process, certain of these factors appear to have major significance. First, a nickel strike coating is electroplated on the steel core rods to a closely controlled thickness adequate for sealing the surface but not sufficiently thick to cause stress cracking, which would result in inadequate adherence. Second, the rods are dipped in an acidified rinse bath after receiving the nickel strike and before reaching the acid copper bath to prevent passivation of the nickel. Third, the permanent immersion of the rods in the copper plating bath throughout the deposit of copper, with cathode connections made to the rods only at their ends, appears to produce a plating of substantial uniformity and density in the bright acid copper bath. Fourth, the copper plating process proceeds with a high level of air agitation around the anodes and at the rod surfaces. Fifth, the temperature of the bath is closely maintained within a predetermined temperature ranges by continuous recirculation through a heat exchanger, this temperature being substantially above the previously published recommended levels.

BRIEF DESCRIPTION OF THE DRAWING

FIG. 4 is an end view of a rack carrier illustrating the attachment of a vertical end rack member thereto.

FIG. 5 is a fragmentary elevation illustrating the rack supports for a rod or work piece and the electrical end connections thereto.

FIG. 6 is a side elevation taken on line 6—6 of FIG. 5.

FIG. 7 is a side elevation taken on line 7—7 of FIG. 5.

FIG. 8 is a side elevation taken on line 8—8 of FIG. 5.

DETAILED DESCRIPTION

The sequential steps of the plating process are next described in outline. Following this, the structures of the racks and rack carriers, the electrical connections thereto and their orientation with respect to the anodes, the air agitating means and the other components of the copper plating tank are described. Finally, details and parameters of the several steps in the plating process are more fully described.

Figure 9:
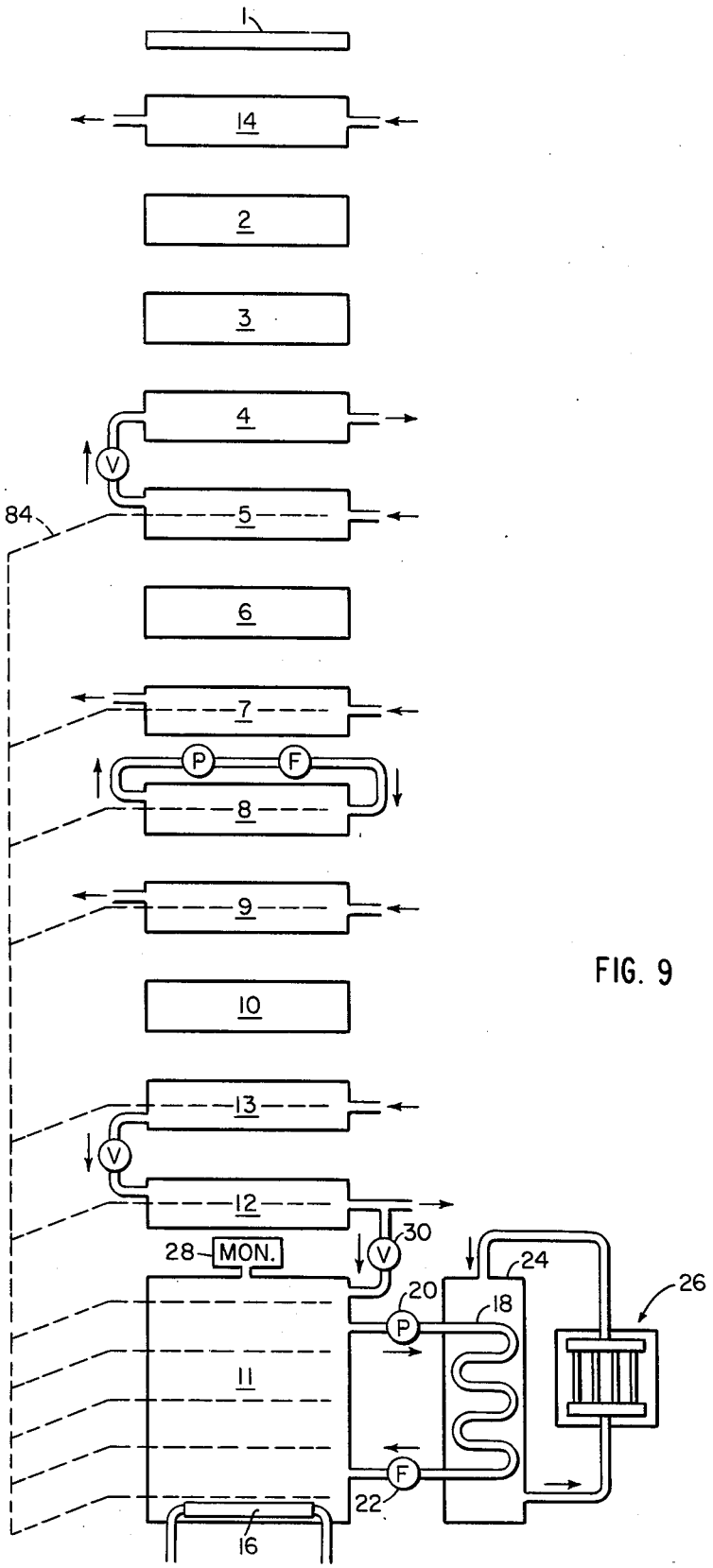
FIG. 9 is a schematic diagram representing, in plan view, the sequential stations in the plating process according to this invention.

FIG. 9 shows 14 stations through which the rods pass in a complete plating cycle. These stations are identified in the drawing numbered in the sequence of progression, namely:

1—Load
2—Soak clean
3—Anodic electroclean
4—Rinse
5—Rinse
6—Muriatic acid
7—Rinse
8—Nickel strike
9—Rinse
10—Acidified rinse
11—Acid copper
12—Rinse
13—Rinse
14—Hot rinse The core rods are preferably C1018 cold drawn steel rods, although other cores having the desired mechanical strength and substantially uniform surface condition may be used. Cold drawing of the rods generally provides the requisite surface condition for use in the present process. The rods are loaded in vertical tiers in racks more fully described hereinafter with reference to FIGS. 1 to 8.

After the rods are loaded in a rack at station 1, they are transported by an automatically programmed hoist to a soak clean station 2. This station and each of the successively numbered stations up to a station 14 comprise separate lined or coated steel tanks of sufficient length to receive the loaded racks, and all tanks except tank 11 are intended to receive a single rack at a time. In an exemplary embodiment, the tank 11 is of sufficient size to accommodate 5 racks at a time, thereby allowing for the relatively greater immersion time in this tank. The hoist is preferably program-controlled in a known manner to advance each rack through the stations in sequence, and allowing each rack to remain at each station for the corresponding time period hereinafter more fully detailed.

The rinse tanks are provided with suitable inlet and outlet connections leading to a supply of water (not shown) for continuous circulation. In addition, water is conserved by cascading as illustrated from certain rinse tanks such as the tank 5 to a preceding rinse tank such as the tank 4, in a conventional manner.

Air agitation is employed in a number of the tanks, and is illustrated in FIG. 9 schematically by broken lines at the left side of the diagram. A perforated pipe is mounted longitudinally at the bottom of each such tank, and connected externally to a source of oil free air. Preferably, these air pipes are located directly beneath the rods when the racks are in position.

Titanium steam pipes 16 are mounted in the tank 11, and steam is circulated to bring the temperature of the plating bath in the tank 11 to the predetermined operating temperature, for example 120° F. Once the plating current has been turned on, the plating process produces heat that must be dissipated in order to maintain the above temperature. This is accomplished by continuous recirculation of the plating bath solution through a graphite heat exchanger coil 18 by means of a pump 20. A filter 22 is provided to remove sediment. The means for dissipating heat from the heat exchanger coil is entirely conventional, and therefore the drawing is intended only as a schematic representation. A water jacket represented at 24 is preferably connected externally of the building to a cooling tower 26, all in accordance with conventional practice.

During the plating process the concentration of the brighteners in the plating bath is constantly maintained by a monitor 28 which monitors the ampere hours of operation and feeds in the make-up brightener and maintenance brightener at predetermined rates.

A valve 30 is provided for optional use to provide make-up water for the tank 11, thereby compensating for evaporation.

Figures 1, 2, 3:
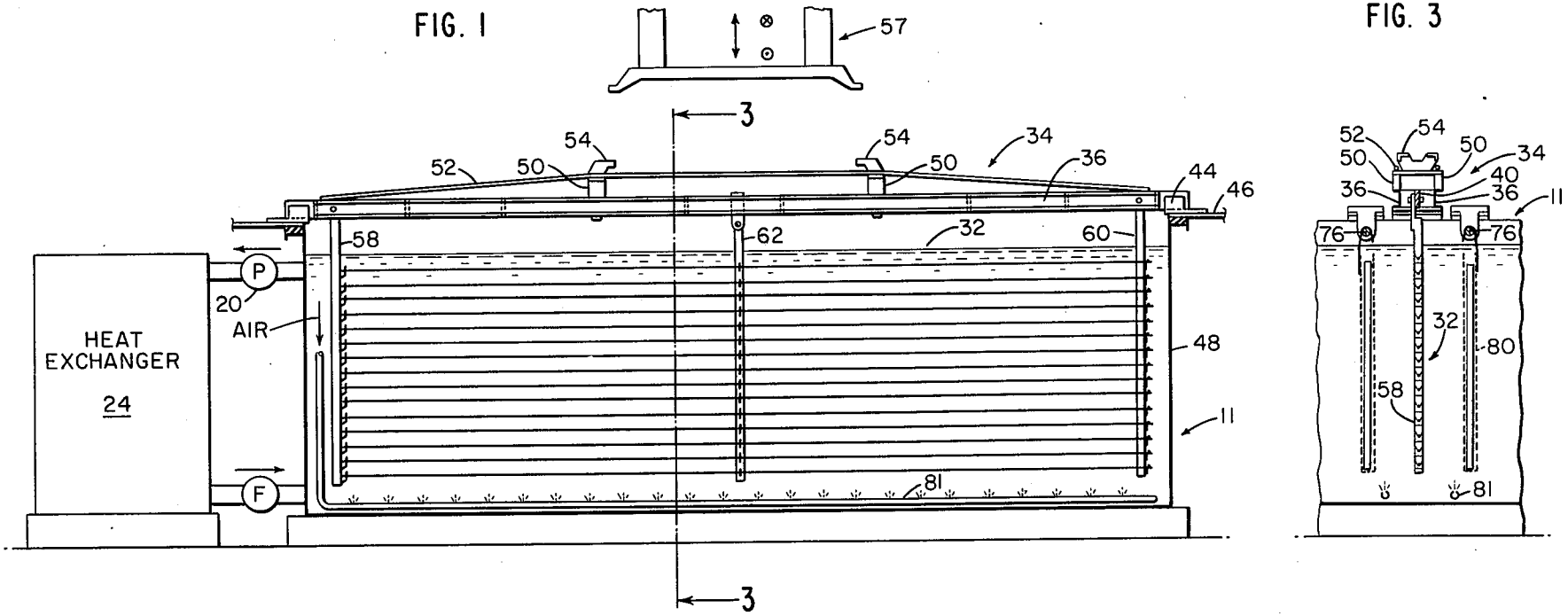
FIG. 1 is an elevation in section of the bright acid copper plating tank, showing a rack loaded with rods immersed therein.
FIG. 2 is a fragmentary plan view corresponding to FIG. 1 showing a single rack carrier.
FIG. 3 is an elevation in section taken on line 3—3 in FIG. 1.

FIGS. 1 to 3 show the tank 11 with a rack 32 immersed therein. The rack is supported by a rack carrier generally designated 34. The rack carrier 34 is a rigid structure including two elongate steel carrier bars 36 of channel cross section rigidly connected together in parallel spaced relationship by end brackets 37 and welded steel struts 38. An elongate solid copper cathode bar 40 is located between the carrier bars 36 and supported by the struts 38. The cathode bar is also rigidly connected to the end brackets 37 connected to the carrier bars, and extends beyond these brackets to rest by gravity within bronze saddles 44 bolted on a fixed bus system 46. This system is supported on insulators by the walls 48 of the tank. The bus system 46 is connected to the negative side of a system of rectifiers (not shown). Thus the rack carrier is supported only by the saddles 44 and is at negative potential.

To improve the rigidity of the rack carrier, steel channel upright brackets 50 are welded to the carrier bars 36, and steel brace rods 52 are welded to the ends of the carrier bars and to the brackets. Lugs 54 are welded on the brackets 50 by means of interconnecting bridge plates 56 as shown more particularly in FIG. 4. The lugs 54 cooperate with a hoist 57 of commercially available construction.

The rack 32 is bolted on the rack carrier 34, and comprises two vertical copper end rack members 58 and 60 and one vertical, non-conducting center rack member or support 62. The end rack members 58 and 60 are bolted to the cathode bar 40 as shown by a bolt 64 in FIG. 4. These connections are secure, as the current is conducted from the bus system 46 through the saddle 44, the cathode bar 40 and these connections to the respective end rack members 58 and 60 to the rods. The center rack member 62 is not current-conducting, and is preferably supported by the cathode bar by any convenient means such as a stirrup hung over the bar and adjustable for different rod lengths.

The end rack member 58 has a series of stainless steel V-notched brackets 66 bolted to it, each adapted to receive a work piece or rod 68 in such manner that the rod will abut the rack member 58 upon longitudinal movement in its direction. The center support rack member 62 has a series of hooks 70 for receiving the rods. The vertical end rack member 60 has stainless steel spring clips 72 welded to it, as shown in FIG. 8. These clips are adapted to apply pressure to retain the rods in notches 74 on projections from the end rack member 60.

All immersed surfaces of all parts of the end rack members 58 and 60 and the center support member 62 are coated with plastisol or any other inert plastic, except the surfaces in direct contact with the rods 68, to prevent such surfaces from receiving deposits of copper. During the plating process, "treeing" readily develops at any pinholes or bare metal areas in electrical connection with the cathode bar, and it is necessary to remove the trees from the rack members prior to reloading with a new set of rods, either mechanically or by a nitric acid stripping bath.

Round solid copper anode bars 76 are supported on suitable insulators on the tank 11 and above the bath. The anode bars are connected to a bus system 78 connected with the positive side of the rectifier supply. The anode bars are located centrally between each pair of rack carriers 34, and additional anode bars are located between the end rack carriers and the adjacent walls of the tank 11. Titanium holding baskets 80, each having a copper hook 82 bolted and silver soldered thereto, are hung on the anode bars 76 by means of these hooks, thereby making electrical connection with the positive side of the rectifier power supply. The hooks are coated with plastisol except at their points of contact with the anode bars. Each of these baskets contains a plurality of anodes which are preferably copper chunks. The anodes preferably have a phosphorous content of between 0.025 and 0.06 percent. The titanium anode baskets are preferably constructed in the manner described in U.S. Pat. No. 3,300,396, dated Jan. 24, 1967 to Charles T. Walker.

Perforated air pipes 81 are located at the bottom of the tank 11 and extend at least the length of the rods. The perforations in the pipes are located so as to cause air bubbles to pass over and around the anodes as well as the rods for efficient agitation of the plating bath.

Having thus generally described the steps of the plating process and certain features of the rack construction as well as that of the tank 11, we turn next to a more detailed description of the process. This is described in relation to the plating of ground rods up to one inch in diameter.

Cold drawn steel rods to C1018 or equivalent in physical strength and surface condition are placed on a rack in the loading and unloading station 1. As previously noted, the connections of these rods to the cathode bar are established only by the end rack members 58 and 60. In operation, the current flowing through each end rack member to the cathode bar 40 may be as high as 3,000 amperes.

A standard programmed hoist system transports the loaded rack from the station 1 to the station 2, comprising a tank having a commercial soak cleaner in water at a concentration of 9 to 11 ounces per gallon by weight at a temperature of 180° F. After at least eight minutes in this tank, the rack is moved to the tank 3. This tank is of conventional construction, and contains a commercial electro-cleaner in water at a concentration of 11 to 13 ounces per gallon by weight at a temperature of 180° F. The tank has saddles connected to the positive side of a rectifier power supply and steel cathodes connected to the negative side, as is conventional in such electro-cleaners, and current passes through the rods between the anode and cathode at a density of approximately 60 amperes per square foot of rod surface area. This process continues for at least eight minutes.

The rack then moves to the tank 4 through which fresh water at room temperature is circulated.

The rack moves from the tank 4 to a tank 5 which is also supplied with fresh water at room temperature, this water being air agitated as shown by a broken line 84 in FIG. 9. Air agitation is produced by a perforated pipe placed longitudinally at the bottom of the tank 5 in position to cause the bubbles to rise up directly underneath the rods. In the subsequent steps including air agitation, the air is agitated in a substantially identical manner.

From the tank 5, the rack passes to the tank 6 containing muriatic acid at a concentration of 9 to 11 percent (0.9–1.1 normal) at 120° F. The rack remains in this solution for at least eight minutes.

The rack then passes to the tank 7 where it receives a fresh water rinse with air agitation at room temperature.

The nickel strike bath in the tank 8 is prepared in the following manner. Nickel chloride hexahydrate is added to water in the tank 8 to a concentration of 19 to 21 ounces per gallon by weight. Boric acid is also added to a concentration between 3.9 and 4.1 ounces per gallon by weight. Sufficient hydrochloric acid is added to adjust the PH to 2.8–3.0. The bath is maintained at a temperature of 120° F. This tank is electrified by connections of a negative terminal to the saddles supporting the cathode bar and a positive terminal to nickel anodes, and current is passed between the positive and negative terminals through the rods at a current density of approximately 37 amperes per square foot for three minutes.

The solution in the tank 8 is continuously recirculated through a filter by means of a pump as shown in the drawing by conventional symbols F and P, respectively. It has been determined that the thickness of the nickel strike coating must be sufficient to seal the surface of the steel, and that it must be non-porous to prevent the acidified rinse in the tank 10 and the plating bath in the tank 11 from attacking the steel core. In practice, the nickel coating is deposited to a thickness of between 88 millionths and 100 millionths of an inch.

The rack then passes to a tank 9 where it receives a fresh water rinse with air agitation at room temperature.

The tank 10 contains sulfuric acid in solution at a concentration of one percent by volume, at room temperature. The rack is dipped into the tank 10, and immediately removed therefrom to the tank 11.

The plating bath in the tank 11, having a capacity of 7200 gallons, is prepared as follows. A copper sulfate pentahydrate is added to water in the tank to a concentration between 30 and 34 ounces per gallon by weight. Sulfuric acid is added to the tank to a concentration between 8 and 10 ounces per gallon by weight to produce the necessary conductivity. The bath is further provided with chloride ions by adding sufficient hydrochloric acid to bring the chloride ion concentration to between 50 and 120 milligrams per liter. The tank still further contains 30 gallons of make-up brightener such as "UBAC HS Make-up", and 15 gallons of maintenance brightener such as "UBAC HS Maintenance," these two brighteners being sold commercially by The Udylite Company, a division of Oxy Metal Finishing Corporation.

As noted above, the brighteners are consumed during the plating process and must be periodically replenished by the monitor device 28. The rate of consumption of each brightener in this process is approximately one gallon per 48,000 ampere hours.

It has been observed that the temperature of the copper plating bath may fluctuate within certain limits above and below a preferred temperature of 120° F., for example between 110 and 130 degrees, without undue interference with the quality of the plate and without causing the other above-described side effects of elevated temperatures. However, to maintain the temperature within this range, the process will inevitably require the use of a heat exchanger as described.

A typical current density during operation as described in the above detailed example is above 120 amperes per square foot of rod area. It has been demonstrated that the current density can be increased to at least double this figure provided there is sufficient air agitation, consistent control over the nickel strike according to the criteria described above, and consistent use of the acid dip in the tank 10 prior to the copper plating step.

A measure of the rapidity with which rods can be plated according to the above-described process is given by the following example. In equipment constructed and operated as described herein, rods as large as 10 feet long and 0.542 inch in diameter may be plated to a copper thickness of 0.011 inch in 51 minutes at a current density of 240 amperes per square foot of rod area. For the same number of rods 16 feet long and the same diameter, the same thickness in copper is plated in one hour and 20 minutes at 150 amperes per square foot. The time, current density and total current are thus interrelated in an apparent manner.

In the tank 11 comprising five cells or racks of rods, there are six anode bars upon which 80 titanium holding baskets 80 are hung. With 40 to 50 anodes per basket providing an average anode surface area of 10.4 to 13 square feet per basket, operation at a current density of approximately 30 to 36 amperes per square foot of anode area occurs at full load.

Throughout the copper plating period, the bath is air agitated to a maximum extent. This feature is deemed of major significance in the achievement of higher current densities according to this invention. The function of air agitation is to provide maximum solution velocity over the anode and cathode surfaces, preventing excessive polarization of either surface which would cause rough or powdery and non-adherent copper deposits. Further, the vigorous air agitation moves the solution that is contiguous to the cathode surface in the electrolyte to insure exposure to copper ions in the bath and to aid in the exposure to fresh brighteners.

A major unexpected advantage of the present process has been the control of build-up of copper sulfate. It is believed that this is attributable to a combination of several features of the process, notably the presence of a sufficiently high phosphorous content in the anode copper, the reduced surface area of the anodes, the close maintenance of the temperature of the plating bath, and the monitored control over the brighteners consumed during operation.

The tanks 12 and 13 each provide a water rinse with air agitation at room temperature.

The tank 14 provides a final rinse with a concentration of 0.1 percent of Cobratec 99, a benzotriazole, sold commercially by Sherwin Williams Chemical Co. This solution is maintained at a temperature of 120° F.

The rack containing the plated rods is then unloaded for final finishing operations. These operations include cutting the rods to the proper length and forming the driving tips by machining or other suitable forming operations.

By means of the above-described process and apparatus, it has been possible to produce a highly pure, dense and consistent copper plate on the rods, as shown by photomicrographs. Thus it has been possible to eliminate the use of a cyanide plating bath. The nickel strike coating ensures a highly effective molecular bond to the steel core, and aids in producing a smooth, bright plated surface. These features have been attained at a sufficiently high production speed to render the product commercially competitive as compared with cyanide copper plated ground rods.

We claim:

1. The process of electroplating copper on steel rods, comprising the steps of electrolytically depositing on the rods a strike coating sufficient to seal the steel surface against attack by acid, and electrolytically depositing copper on the rods from phosphorized copper anodes in a bright acid copper sulfate bath while maintaining the bath at a temperature exceeding 110 degrees F., the rods being held stationary and continuously immersed in the bath during copper plating, the electrical current density at the rod surfaces exceeding 120 amperes per square foot.

2. The process according to claim 1, in which the bright acid bath is continuously and vigorously agitated by air bubbles.

3. The process according to claim 1, in which the bright acid bath solution is continuously circulated through a heat exchanger.

4. The process according to claim 1, including the step of dipping the rods in a sulfuric acid solution after electrolytic deposit of a strike coating and before copper plating, said solution having an acid concentration of less than two percent by volume.

5. The process according to claim 1, in which each rod has cathode connections exclusively near the ends thereof.

6. The process according to claim 1, in which the strike coating comprises a layer of nickel having a thickness less than about 150 millionths of an inch.

* * * * *